US005278024A

United States Patent [19]

Cotner et al.

[11] Patent Number: 5,278,024

[45] Date of Patent: Jan. 11, 1994

[54] POSITIVE IMAGING DIFFUSION-TRANSFER DRY SILVER SYSTEM USING FORMAZAN DYE

[75] Inventors: Richard C. Cotner, Stillwater; David C. Weigel, White Bear Lake; Kumars Sakizadeh, Woodbury, all of Minn.

[73] Assignee: Minnesota Mining and Manufacturing Company, Saint Paul, Minn.

[21] Appl. No.: 998,445

[22] Filed: Dec. 30, 1992

Related U.S. Application Data

[62] Division of Ser. No. 722,178, Jun. 27, 1991, Pat. No. 5,206,112.

[51] Int. Cl.[5] ..... G03C 5/54

[52] U.S. Cl. ..... 430/203; 430/259; 430/263; 430/619; 430/351; 430/559

[58] Field of Search ..... 430/203, 201, 222, 224, 430/619, 559, 351

[56] References Cited

U.S. PATENT DOCUMENTS

| | | | |
|---|---|---|---|
| 3,457,075 | 7/1969 | Morgan et al. | 96/57 |
| 3,531,286 | 9/1970 | Renfrew | 96/67 |
| 3,655,382 | 4/1972 | Brault et al. | 96/48 |
| 3,671,244 | 6/1972 | Bissonnette et al. | 96/54 |
| 3,676,135 | 7/1972 | Musliner | 96/54 |
| 3,839,049 | 10/1974 | Simons | 96/114.6 |
| 3,985,565 | 10/1976 | Gabrielsen et al. | 96/114.1 |
| 4,021,240 | 5/1977 | Cerquone et al. | 96/29 |
| 4,022,617 | 5/1977 | McGuckin | 96/29 |
| 4,042,392 | 8/1977 | Gysling et al. | 96/48 |
| 4,187,108 | 2/1980 | Willis | 430/203 |
| 4,374,921 | 2/1983 | Frenchik | 430/338 |
| 4,426,441 | 1/1984 | Adin et al. | 430/351 |
| 4,430,415 | 2/1984 | Aono et al. | 430/203 |
| 4,455,363 | 6/1984 | Naito et al. | 430/203 |
| 4,460,681 | 7/1984 | Frenchik | 430/502 |
| 4,463,079 | 7/1984 | Naito et al. | 430/203 |
| 4,499,172 | 2/1985 | Hirai et al. | 430/203 |
| 4,499,180 | 2/1985 | Hirai et al. | 430/559 |
| 4,503,137 | 3/1985 | Sawada | 430/203 |
| 5,206,112 | 4/1993 | Cotner et al. | 430/203 |

*Primary Examiner*—Richard L. Schilling

*Attorney, Agent, or Firm*—Gary L. Griswold; Walter N. Kirn; Gregory A. Evearitt

[57] ABSTRACT

A photothermographic composite structure for use in a solvent-free dye thermal positive imaging diffusion-transfer process comprising:

(a) an image-receiving element comprising a polymeric dyeable image-receiving layer having a glass transition temperature in the range of 20° to 200° C., and (b) strippably adhered to said image-receiving element, an imageable photothermographic element comprising in at least one layer thereof a binder, a silver source material, photosensitive silver halide in catalytic proximity to said silver source material, and a formazan dye.

5 Claims, No Drawings

POSITIVE IMAGING DIFFUSION-TRANSFER DRY SILVER SYSTEM USING FORMAZAN DYE

This is a division of application Ser. No. 07/722,178, filed Jun. 27, 1991, now U.S. Pat. No. 5,206,112.

FIELD OF THE INVENTION

The present invention relates to a photothermographic imaging system of the dry silver type for providing a positive image by diffusion-transfer. This invention also relates to a process for providing a positive image by thermal diffusion-transfer.

BACKGROUND OF THE INVENTION

Silver halide photothermographic imaging materials, often referred to as "dry silver" compositions because no liquid development is necessary to produce the final image, have been known in the art for many years. These imaging materials basically comprise a light insensitive, reducible silver source; a light sensitive material which generates silver when irradiated; and a reducing agent for silver ions. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075). coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as a latent image. This latent image generally is not visible by ordinary means and the light sensitive article must be further processed in order to produce a visual image. The visual image is produced by the catalytic reduction of silver ions which are in catalytic proximity to the specks of the latent image.

As the visible image is produced entirely by silver, one can not readily decrease the amount of silver in the emulsion without reducing the available maximum image density. Reduction of the amount of silver is desirable in order to reduce the cost of raw materials used in the emulsion.

One traditional way of attempting to increase the image density of photographic and photothermographic emulsions without increasing or while decreasing the amount of silver in the emulsion layer is by the addition of dye forming materials in the emulsion. In this way a dye enhanced silver image can be produced, as for example in U.S. Pat Nos. 3,531,286, 4,187,108, 4,426,441, 4,374,921 and 4,460,681.

It has been described in the patent literature to transfer a dye image formed in a photothermographic system by means of a transfer solvent as is disclosed, for example, in U.S. Pat. Nos. 3,985,565, 4,021,240, 4,02216171 4,430,415, 4,463,079, 41455,363, 4,499,172, 4,499,180, and 4,503,137.

Japanese Kokai No. 59-5239 discloses a photothermographic contact diffusion system wherein a chemical reaction occurs in an image receiving layer between a diffused leuco dye and an acidic color developing agent.

U.S. Pat. Nos. 3,655,382; 3,676,135; 3,671,244; and 4,042,392 disclose the use of formazan dyes in a conventional (wet) silver halide, non-thermographic construction.

SUMMARY OF THE INVENTION

In accordance with the present invention, it has now been discovered that when a formazan dye is introduced into a dry silver color thermal dye transfer diffusion process, a positive image can be diffused into a receptor layer after light exposure and heat development to form a positive dye image. A negative silver image is also attained in the silver containing layer(s), but this image is subsequently removed by stripping all layers from the receptor layer.

Accordingly, the present invention provides a photothermographic composite structure comprising:

a) an image-receiving element comprising a polymeric image-receiving layer having a glass transition temperature in the range of 20° to 200° C.; and b) strippably adhered to the image-receiving element, an imageable photothermographic element comprising in at least one layer thereof a binder, a silver source material, photosensitive silver halide in catalytic proximity to the silver source material, and a formazan dye.

The present invention makes possible a silver-free colored dye image reproduction by a dye thermal diffusion-transfer process without use of chemicals, solvents, or post-treatments to aid in the transfer process. A photothermographic reaction in a heat-developable, photosensitive layer(s) containing a formazan dye, an organic silver salt, a photocatalyst and preferably developer modifier(s), yields the reduction of silver to create a silver image in the irradiated portions of the photothermographic element. The formazan dye undergoes oxidation to its colorless form (tetrazolinium salt) in the same irradiated portion of the photothermographic element. The remaining formazan dye can be diffusion-transferred into a dyeable, polymeric, image-receiving layer which is coated or placed in intimate contact adjacent to the heat developable photosensitive layer(s) yielding a positive dye image in the non-irradiated portion of the photothermographic element, only heat is required in the transfer process.

The heat-developable, photosensitive layer(s) of the invention can be strippably adhered to the image-receiving layer on the same substrate to form a single composite structure, or, in another embodiment, the heat-developable, photosensitive layer(s) is separately coated on a different (or second) substrate from that of the image-receiving element. In the latter embodiment, the image-receiving layer of the image-receiving element and the exposed photosensitive layer of the photothermographic element are placed in intimate contact with each other (i.e., pressed together in a two-sheet assemblage) before development of the image, subsequently, the imaged photothermographic element is stripped away from the receiving layer with its dye image.

In the present invention each of the elements (the photothermographic and image-receiving) may, independently and optionally, be adhered to a support. Preferably, the support comprised a polymeric resin which is chosen to require no adhesive for the element to adhere to a support, although an adhesive may be used.

In every case, it is required that the latent image-bearing and the image-receiving layers be in intimate face-to-face contact with each other during development of the image. Exposure can be through either the image-receiving element or the photothermographic element. For this to be possible, at least one of the elements and its support, when present, must be transparent.

After imagewise exposure and subsequent heat development and simultaneous thermal diffusion-transfer of the dye into the image-receiving layer, the photosensitive layer(s) which contain a reduced silver image is dry-stripped away from the image-receiving layer to provide a pure and clear dye image not contaminated with the reduced metallic silver image on the image-receiving layer.

No special solvents are used in the diffusion-transfer process and the present invention method requires no color coupler or other chemicals in the image receiving layer to provide the dye image.

DETAILED DESCRIPTION

The present invention provides a photothermographic composite structure comprising: (a) a dyeable image-receiving element comprising a polymeric image-receiving layer having a glass transition temperature in the range of 20° to 200° C., which image-receiving layer is optionally adhered to at least one surface of a support; and (b) strippably adhered to the polymeric image-receiving layer, an imageable photothermographic element comprising, in at least one imageable layer thereof a binder, a silver source material, photosensitive silver halide in catalytic proximity to the silver source material, and a formazan dye.

In the present invention, "strippably adhered" means, as is well understood in the art, that the layers are sufficiently well adhered to each other to survive mild handling without the layers separating and yet still be separable from each other by hand when required without tearing of individual layers. This generally means that a peel force (delaminating resistance) of about 1 to 50 g/cm width (0.1 to 4.5 ounces per inch width) of layer is needed to separate the two layers when one layer is pulled at 180° from the other at about 127 mm (5 inches) per minute. Preferably this peel force is in the range of 1 to 20 g/cm width (0.1 to 1.8 ounces per inch width).

When the heat-developable, imageable, color photothermographic construction of the invention is imagewise exposed to actinic radiation (i.e., infrared, visible, ultraviolet, x-ray, and electron beam) and then heat-developed, an oxidation-reduction reaction occurs between the organic silver salt and the formazan dye by means of an exposed light sensitive silver halide as a catalyst. Accordingly, a reduced silver image and an oxidation of the formazan dye to its colorless tetrazolinium salt are simultaneously formed in the light-exposed area of the material. The remaining formazan dye image (in the non-light exposed areas) can be thermally diffusion-transferred to an image-receiving layer. The thermal development of the tetrazolinium salt and the thermal diffusion-transfer of the formazan dye to the image-receiving layer occurs simultaneously without use of any post-treatment, chemicals, or transfer solvents.

After the heat-development, the heat-developable photosensitive element containing the reduced negative metallic silver image and other chemical reactants can be peeled apart from the dye-bearing image-receiving layer. A pure and stable positive dye image is obtained on the image-receiving layer.

The imageable photothermographic element of the present invention can be a unitary layer or it can comprise two or more layers as is well known in the art.

The optional support bases or substrates of the photothermographic imageable element of the invention as well as of the image-receiving element can be any supporting materials such as paper, polymeric (plastic) film, glass, or metal. At least one of the imageable and image-receiving elements must be flexible and at least one must be transparent to allow for imaging and stripping functions. Transparent or opaque polymeric films are particularly useful. Preferably, the support comprises a thermoplastic resin which is useful as the polymeric image-receiving layer, e.g., polyesters such as polyethylene or poly(ethylene terephthalate); cellulosics such as cellulose acetate, cellulose butyrate, cellulose acetate butyrate, cellulose propionate, cellulose acetate propionate; polyolefins such as polystyrene; polyvinyl resins such as polyvinylchloride and polyvinylacetate; copolymeric vinyl resins such as copolymer of vinylchloride-vinylacetate, copolymer of vinylidene chloride-acrylonitrile, and copolymer of styrene-acrylonitrile. This eliminates an additional preparation (or coating) of the image-receiving layer. Combinations of resins (binders) are also useful.

The formazan dye, which can be present in the photosensitive layer or in an adjacent layer, can be any colored or lightly colored formazan compound which can be oxidized (bleached) to a non-colored form and which when heated to a temperature in the range of 80° to 250° C. (176° to 482° F.) for a time period of 0.5 to 300 seconds diffuses into the thermoplastic resin-containing receiving layer of the invention.

Preferably, the formazan dye(s) utilized in the present invention will be chosen from the group of dyes having the general structure shown below:

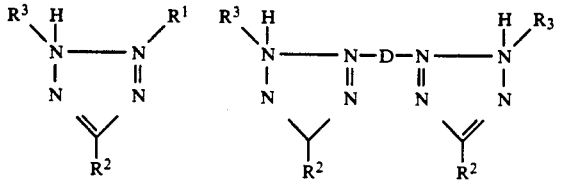

-continued

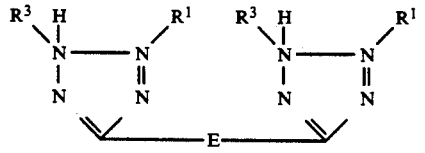

wherein:

$R^1$ and $R^3$ each individually are selected from the group consisting of aryl (e.g., phenyl, tolyl, butylphenyl, sulfonamidophenyl, sulfamylphenyl, nitrophenyl, naphthyl, B-naphthyl, carbamylnaphthyl, sulfonamidonaphthyl, sulfamylnaphthyl, nitronaphthyl, etc.) and heterocyclic, preferably containing from 5 to 6 carbon atoms with heteroatoms selected from nitrogen, oxygen, sulphur, and selenium, (e.g., thiazolyl, benzothiazolyl, selenazolyl, benzoselenazolyl, benzimidazolyl, naphthimidazolyl, triazinyl, pyrimidinyl, pyridyl, quinolyi, thienyl, etc.)

$R^2$ is selected from the group consisting of $R^1$, $R^3$, hydrogen, alkyl (e.g., methyl, butyl, hexyl, dodecyl, mercaptomethyl, mercaptoethyl, etc.) carboxy ester (e.g., methoxycarbonyl, ethoxycarbonyl, phenoxycarbonyl, etc.). amino (e.g., ethylamino, dimethylamino, anilino, etc.), carbamyl (e.g., carbamyl, ethylcarbamyl, dimethylcarbamyl, phenylcarbamyl, etc.), sulfonamido (e.g., methylsulfonamido, butylsulfonamido, phenylsulfonamido, etc.), sulfamyl (e.g., sulfamyl, methylsulfamyl, butylsulfamyl, phenylsulfamyl, etc.), nitro, and cyano;

D represents arylene (e.g., phenylene, diphenylene, naphthylene, etc.); and

E is chosen from group consisting of alkylene (e.g., methylene, ethylene, propylene, butylene, etc.); arylene (phenylene, diphenylene, naphthylene, etc.); and arylene alkylene (e.g., phenylene methylene, phenylene butylene, phenylene, hexylene, naphthylene methylene, naphthylene butylene, naphthylene propylene, etc.).

Such formazan dyes are known to those skilled in the art and are commercially available. They are typically prepared by the reduction of the corresponding tetrazolinium salts.

The formazan dye can be represented in the imageable photothermographic layer(s) in the range of 0.1 to 20 weight percent, preferably 0.25 to 15 weight percent.

The silver source material, as mentioned above, may be any material which contains a reducible source of silver ions. Silver salts of organic acids, particularly long chain (10 to 30, preferably 15 to 28, carbon atoms) fatty barboxylic acids are preferred. Complexes of organic or inorganic silver salts wherein the ligand has a gross stability constant for silver ion of between 4.0 and 10.0 are also desirable. The silver source material should constitute from about 7 to 70 percent by weight of the heat-developable, photosensitive layer(s).

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.01 to 15 percent by weight of the heat-developable, photosensitive layer, although larger amounts up to 20 or 25 percent are useful. It is preferred to use from 0.1 to 10 percent by weight silver halide in the heat-developable, photosensitive layer and most preferred to use from 0.1 to 2.0 percent. The silver halide used in the invention can be chemically and spectrally sensitized in a manner similar to the conventional wet process silver halide or state-of-the-art heat-developable photographic materials.

A reducing agent for silver ion besides the formazan dye is not essential to the construction but can be added into the heat-developable photosensitive layer(s) as an accelerator of the development rate, if necessary. Conventional photographic developers such as phenidone, hydroquinones, and catechol are useful in minor amounts, and hindered phenol reducing agents may also be added. The reducing agent should be present as 0.1 to 10 percent by weight of the imaging layer. In a two-layer construction, if the reducing agent is in the second layer, slightly higher proportions, of from about 0.1 to 15 percent, tend to be more desirable.

To modify the development rate or color, development modifiers, present in a range of 0.01 to 10 weight percent of the coating solution can be used. Representative development modifiers include aromatic carboxylic acids and their anhydrides such as phthalic acid, 1,2,4-benzenetricarboxylic acid, 2,3-naphthalene dicarboxylic acid, tetrachlorophthalic acid, 4-methyl phthalic acid, homophthalic acid, 4-nitro phthalic acid, o-phenylacetic acid, naphthoic acid, phthalic anhydride, naphthalic anhydride, tetrachlorophthalic anhydride, and the like.

Toners such as phthalazinone, and both phthalazine and phthalic acid, or derivatives thereof and others known in the art, are not essential to the construction, but are highly desirable. These materials may be present, for example, in amounts of from 0.01 to 10 percent by weight.

The binder for the silver coating is selected from well-known natural and synthetic resins such as gelatin, polyvinyl acetals, polyvinylchloride, polyvinylacetate, cellulose acetate, ethyl cellulose, polyolefins, polyesters, polystyrene, polyacrylonitrile, polycarbonates, methacrylate copolymers, maleic anhydride ester copolymers, and butadiene-styrene copolymers, and the like. When simultaneous coating of layers is used, the binder is selected to coordinate with the solvent used. Copolymers and terpolymers which include the above-stated binders are of course included in these definitions. The preferred photothermographic silver containing binder is polyvinyl butyral. The binders are generally used in a range of from 2 to 55 percent by weight of each layer, and preferably about 5 to 30 percent by weight.

The photothermographic element can also include coating additives to improve the strippability of the imaged layer, e.g., fluoroaliphatic polyesters dissolved in ethyl acetate (Fluorad TM FC 431, 3M, St. Paul, Minn.) can be added in an amount in the range of 0.02 to 0.5 weight percent of the imageable layer, preferably 0.1 to 0.3 weight percent. Alternatively, a coating additive to enhance strippability can be added to the image-receiving layer in the same weight range. No solvents are used in the stripping process. The strippable layer has a delaminating resistance of 1 to 50 g/cm and a layer strength greater than, and preferably at least two times greater than, its delaminating resistance.

Selection of the polymeric resin and solvent used in coating the photosensitive layer is a significant factor in determining strippability of the image-receiving layer. Preferably the polymeric resin in the image-receiving layer is impermeable to the solvent used for the heat-developable photosensitive emulsion and is incompatible with the binder polymer used for the emulsion. The combination of such polymers and solvents results in poor adhesion to each other and provides good strippability.

The dyeable image-receiving layer of the invention is any flexible or rigid, transparent (optically clear) thermoplastic resin-containing layer, having a thickness of at least 0.1 micrometer, preferably in the range of 1 to 10 micrometers, and a glass transition temperature in the range of 20° to 200° C. In the present invention any thermoplastic resin or combination of resins can be used provided it is capable of absorbing and fixing the dye. The resin acts as a dye mordant. No additional fixing agents are required. Preferred polymeric thermoplastic resins that can be used in the image-receiving layer include polyesters such as polyethylene and polyethylene terephthalates, cellulosics such as cellulose acetate, cellulose butyrate, cellulose propionate, polystyrene, polyvinylchloride, polyvinylacetate, copolymer of vinylchloride-vinylacetate, copolymer of vinylidene chloride-acrylonitrile, and copolymer of styrene-acrylonitrile.

The dyeable image-receiving element can consist of at least one of the above-mentioned thermoplastic resins, or the image-receiving layer can comprise the thermoplastic resin dissolved in an organic solvent (e.g., methyl ethyl ketone, acetone, tetrahydrofuran) and applied to the support base or substrate by various coating methods known in the art, such as curtain coating, extrusion coating, dip coating, air-knife coating, hopper coating and any other coating method used for solution coating. After coating the image-receiving element is dried (e.g., in an oven) to drive off the solvent.

Preferably, the image-receiving layer is coated adjacent to the heat-developable photosensitive layer. This facilitates diffusion-transfer of the formazan dye which remains after the image-wise developable, photosensitive layer is subjected to thermal treatment, for example, in a heated shoe and roller type heat processor, as is used in the art. In another embodiment, the colored dye in the heat-developable photosensitive layer can be thermally transferred into a separately coated image-receiving sheet by placing the exposed heat-developable photosensitive layer in intimate face-to-face contact with the image-receiving sheet and heating the resulting composite construction. Good results are achieved in this second embodiment when uniform contact for a time period in the range of 0.5 to 300 seconds between the layers exists during the thermal treatment (in the range of 80° to 220° C.).

The present invention also provides multi-color images prepared by superimposing in register, imaged-receiving layers as prepared above. Such an article requires that the resins of the individual images-receiving layers be sufficiently adherent to provide useful full color reproduction on a single substrate.

Advantages of the heat-developable color photographic material provided by this invention include preparation of pure, clear, and stable positive dye images at high photographic speed, as well as low silver requirement.

The material by this invention can be applied, for example, in conventional color photography, in electronically generated color hard copy recording and in digital color proofing for the graphic arts area because of high photographic speed, the pure dye images produced, and the dry and rapid process provided.

Objects and advantages of this invention are further illustrated by the following examples, but the particular materials and amounts thereof recited in these examples, as well as other conditions and details, should not be construed to unduly limit this invention. All percents are by weight unless otherwise indicated.

EXAMPLE I

A twelve percent solution of vinyl chloride-acetate (VYNS, Union Carbide) in methyl ethyl ketone was coated at a wet thickness of 3.5 mils onto a white opaque polyester film as the image receiving layer and dried at 180° F. for five minutes.

A dispersion of silver behenate half soap was made at eleven percent solids in toluene and ethanol by homogenization. One and a half percent polyvinylbutyral was added after homogenization with mixing. This dispersion was then prepared for coating by the addition of more solvent, halide, resin, and sensitizing dye in a selected sequence of time and mixing. 165 g of the silver soap dispersion was diluted with 190 g ethanol and 190 g methyl ethyl ketone. Then 6 ml of mercuric bromide (0.36 g in 20 ml methanol) was added with stirring for 60 minutes. Next 6 ml of zinc bromide (0.45 g in 20 ml methanol) was added with stirring for 60 minutes. An additional 26.0 grams of polyvinylbutyral was then added followed by 1.0 g surfactant in 10 ml ethanol. 3 ml of blue sensitizing dye, RP 454 (structure as disclosed in U.S. Pat. No. 4,2601677) (0.02 g in 100 ml methanol) was added into 25 g of the resulting dispersion. This dispersion was coated at a wet thickness of 4 mils over the image-receiving layer and dried at 180° F. for 5 minutes.

The topcoat solution consisted of 43.83 percent acetone, 14.09 isopropyl alcohol, 14.09 cellulose acetate (Eastman CA-398-6), 3.70 acrylic resin (Rohm and Haas Acryloid A21), 0.73 phthalazinone. To 25 g of the above premix, 0.25 g phthalazinone, 0.20 g 2,5-diphenyl-3-(1-naphthyl)-2H- formazan (a violet colored dye), and 14.23 g tetrahydrofuran were added. This solution was coated at a wet-thickness of 3 mils over the silver coating and dried at 180° F. for 5 minutes.

The resulting sheets were then exposed via an EG&G sensitometer (EG&G, Inc., Salem, MA) through a Wratten 47 blue color separation filter for one millisecond to produce a developable latent image in the heat developable photosensitive layer and heat-developed at 280° F. via a 3M Model 9014 hot roll processor for 60 seconds.

A violet dye image was present in the unexposed regions. In the light exposed regions, the violet dye was oxidized to its colorless form, leaving only a silver image. The heat developable photosensitive layers having the reduced silver image were stripped off from the image-receiving layer. A clear violet dye was transferred to the image-receiving layer corresponding to the positive image in the heat developable photosensitive layer. Dye was present in the unexposed regions and minimal dye was present in the exposed regions.

The reflection density to green light was measured (Macbeth densitometer, Status A green filter) and the following sensitometric data was obtained from the samples: Dmin 0.20, Dmax 1.40, gamma angle 50 degrees, photospeed 200 ergs per square centimeter.

EXAMPLE II

The same conditions as in Example I were followed with the exception of the image dye. In Example II, 2,3,5-triphenyl formazan ( a red colored dye) was used in place of 2,5-diphenyl-3-(l-naphthyl)-2H- formazan The resulting sheets were then exposed via an EG&G sensitometer (EG&G, Inc., Salem, MA) through a Wratten 47 blue color separation filter for one millisecond to produce a developable latent image in the heat developable photosensitive layer and heat-developed at 280° F. via a 3M Model 9014 hot roll processor for 60 seconds.

A red dye image was present in the unexposed regions. In the light exposed regions, the red dye was oxidized to its colorless form, leaving only a silver image. The heat developable photosensitive layers having the reduced silver image were stripped off from the image-receiving layer. A clear red dye was observed to have been transferred to the image-receiving layer corresponding to the positive silver image in the heat developable photosensitive layer. Dye was present in the unexposed regions and none was present in the exposed regions.

The reflection density to green light was measured (Macbeth densitometer, Status A green filter) and the following sensitometric data was obtained from the samples: Dmin 0.26, Dmax 1.21, gamma angle 43 degrees, photospeed 200 ergs per square centimeter.

EXAMPLE III

The same conditions as in Example I were used with the exception of the image dye. In Example III, 3-[4,5-dimethylthiazol-2-yl]-2,5-diphenylformazan (a blue colored dye) was used in place of 2,5-diphenyl-3-(1-naphthyl)-2H- formazan.

The resulting sheets were then exposed via an EG&G sensitometer (EG&G, Inc., Salem, MA) through a Wratten 47 blue color separation filter for one millisecond to produce a developable latent image in the heat developable photosensitive layer and heat-developed at 280° F. via a 3M Model 9014 hot roll processor for 60 seconds.

A blue dye image was present in the unexposed regions. In the light exposed regions the blue dye was oxidized to its colorless form, leaving only a silver image. The heat developable photosensitive layers having the reduced silver image were stripped off from the image-receiving layer. A clear blue dye was observed to have been transferred to the image-receiving layer corresponding to the positive silver image in the heat developable photosensitive layer. Dye was present in the unexposed regions and none was present in the exposed regions.

The reflection density to red light was measured (Macbeth densitometer, Status A red filter) and the following sensitometric data was obtained from the samples: Dmin 0.36, and Dmax 0.43.

Reasonable modifications and variations are possible from the foregoing disclosure without departing from either the spirit or scope of the present invention as defined by the claims.

We claim:

1. A method of providing a positive color image comprising the steps:

(1) Providing a photothermographic composite structure comprising:

(a) an image-receiving element comprising a dyeable polymeric image-receiving layer having a glass transition temperature in the range of 20° to 200° C., and (b) strippably adhered to said image-receiving element, a photosensitive, photothermographic, element comprising in at least one layer thereof a binder, a silver source material, photosensitive silver halide in catalytic proximity to said silver source material, and a formazan dye, (2) imagewise exposing said photosensitive element of said photothermographic structure to radiation to provide a latent silver image, (3) developing the exposed composite structure by uniformly heating said structure to reduce said latent image;

(4) oxidizing said formazan dye to its colorless form while allowing the remaining formazan dye in the unexposed areas of said photosensitive element to transfer by diffusion without the use of a solvent to said image-receiving layers; and (5) dry-stripping said photothermographic element from said image-receiving element to provide a self-supported positive imaging color image-containing element.

2. The method according to claim 1 wherein said formazan dye is one selected from the group consisting of:

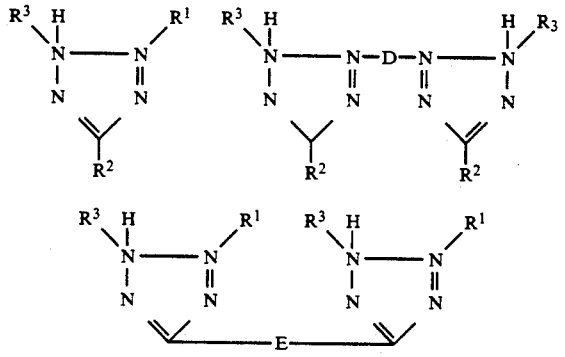

wherein:

$R^1$ and $R^3$ are individually aryl or heterocyclic;

$R^2$ is selected from the group of $R^1$, $R^3$, hydrogen, alkyl, carboxyester, amine, carbamyl, sulfonamide, sulfamyl, nitro, and cyano, D represents arylene; and E is chosen from the group consisting of alkylene, arylene, and arylene alkylene, 3. The method according to claim 1 wherein each of said image-receiving and said photothermographic elements independently further comprise a support.

4. The method according to claim 3 wherein said support is paper, polymeric thermoplastic resin, glass, or metal.

5. The method according to claim 4 wherein said support for said image-receiving layer is a polymeric thermoplastic resin.

* * * * *